US005330071A

United States Patent [19]

Parker

[11] Patent Number: 5,330,071

[45] Date of Patent: Jul. 19, 1994

[54] PLASTIC REFUSE CONTAINER

[75] Inventor: Brian G. Parker, Alto, Mich.

[73] Assignee: Waste Management of North America, Inc., Oak Brook, Ill.

[21] Appl. No.: 929,813

[22] Filed: Aug. 14, 1992

[51] Int. Cl.[5] ..... B65F 3/04

[52] U.S. Cl. ..... 220/645; 220/759; 220/772; 220/908

[58] Field of Search ..... 220/759, 772, 1.5, 908, 220/2, 645; 414/786, 406–408

[56] References Cited

U.S. PATENT DOCUMENTS 2,624,487 1/1953 Fry ..... 220/759
3,009,591 11/1961 Jones ..... 220/772
3,416,852 12/1968 Goldbeck ..... 220/759
3,616,964 11/1971 Yamazaki ..... 220/759
3,623,631 11/1971 Ford .
3,823,972 7/1974 Ramer ..... 294/73
4,335,828 6/1983 Robinson et al. ..... 220/334
4,416,374 11/1983 Smith et al. ..... 206/507
4,550,849 11/1985 Adsit .
4,917,257 4/1990 Edelhoff .
4,969,813 11/1990 Lee et al. ..... 425/503
5,114,304 5/1992 Edelhoff .
5,230,434 7/1993 Patrick et al. ..... 220/1.5

*Primary Examiner*—Joseph M. Moy
*Attorney, Agent, or Firm*—Allegretti & Witcoff, Ltd.

[57] ABSTRACT

A large plastic refuse container including a floor, a front wall, a rear wall, a first end wall, a second end wall and a floor. The plastic refuse container including two attached and opposing side fork pockets to enable the lifting of the container with a fork lift device.

11 Claims, 7 Drawing Sheets

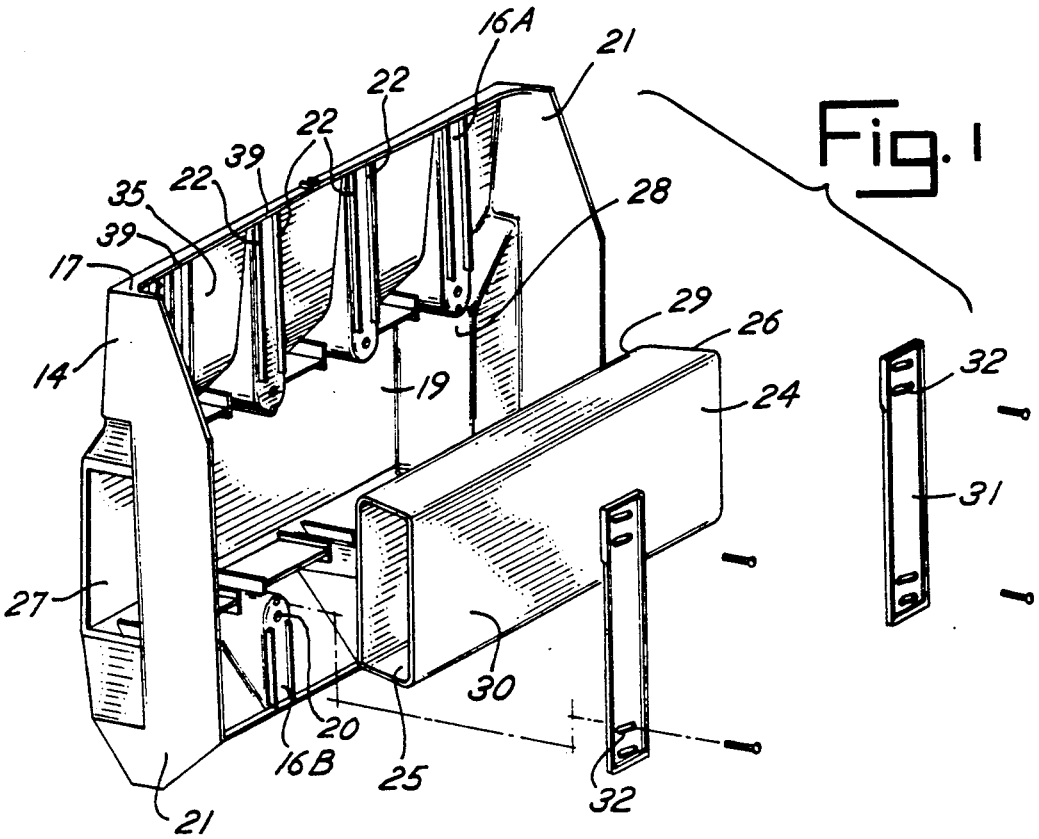
Fig. 1
Fig. 2
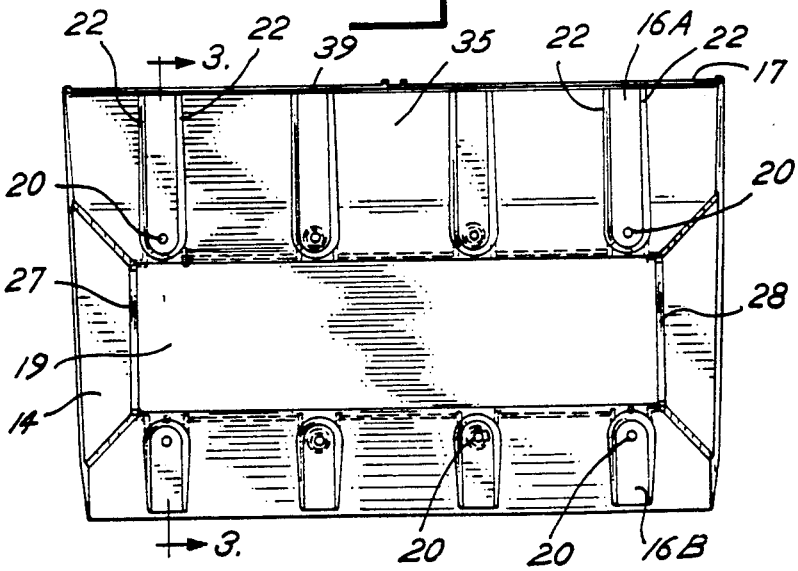
Fig. 3
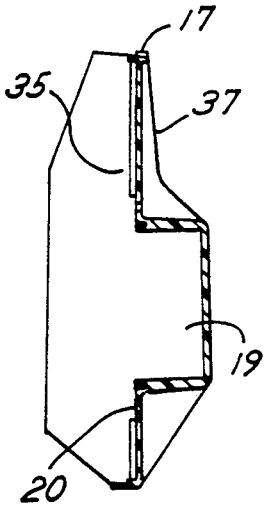

Fig. 11
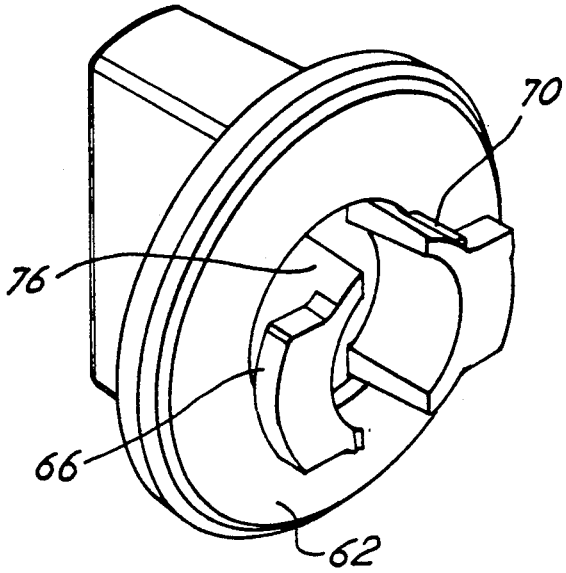
Fig. 14
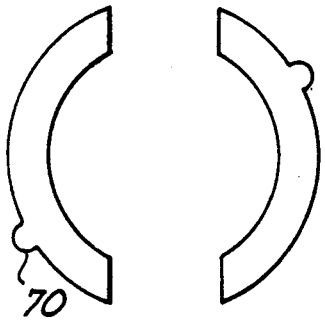
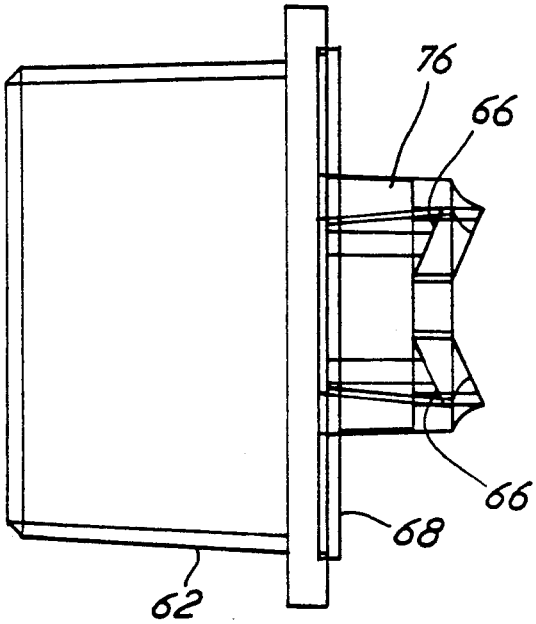
Fig. 12
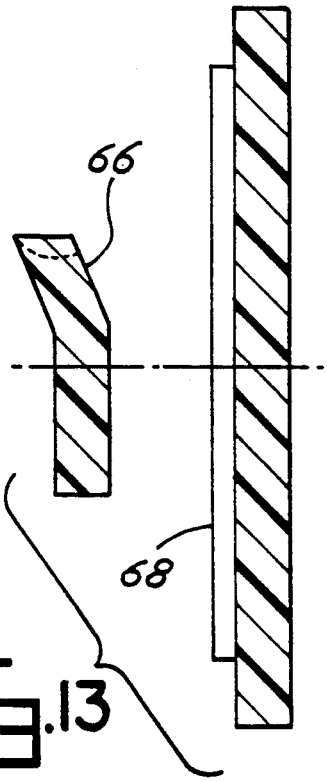
Fig. 13

PLASTIC REFUSE CONTAINER

BACKGROUND OF THE INVENTION

1. Field Of The Invention

The present invention relates to a plastic container and specifically a large plastic refuse container that includes two external side fork pockets secured to walls of the container in a manner that facilitates the lifting of the container with the forks of a refuse truck. Additionally, this invention relates to a refuse container drain, and a refuse container that can be stacked and nested for shipping purposes.

2. Prior Art

The use of plastic to fabricate refuse containers is well known in the art. Until recently however, all large plastic refuse containers, i.e., those having a volume of a yard or more were manufactured by roto-molding, or by blow molding. For example, U.S. Pat. No. 4,496,813 (Lee, et al.) discloses a blow molding apparatus useful for fabricating a plastic container. In contrast, the large plastic refuse container of this invention is manufactured using plastic injection molding techniques. As a result many problems directly related to injection molding the container had to be overcome in designing the plastic refuse container of this invention.

The use of lift tubes associated with refuse containers is well known in the art as shown in U.S. Pat. Nos. 3,623,631 (Ford); 3,823,972 (Ramer); and 4,335,828 (Robinson, et al.) However, the lift tubes of the containers disclosed in those patents are all integral to the walls of metal containers.

The use of a metal lift tube sleeve in conjunction with a plastic container is disclosed in U.S. Pat. No. 4,550,849 (Adsit). However, the metal lift tube of the '849 patent is incorporated into the container during the roto-molding process. Additionally, the lift tubes of the '849 patent are integral to the inside dimension of the container.

U.S. Pat. No. 4,416,374 (Smith) describes stackable or nestable, plastic containers. The containers include platforms in the top portion of the open, inner dimension of the container that are complementary to depressions in the bottom dimension of the same container allowing multiple containers to be stacked, one on top of the other, for shipping and handling purposes. The '374 patent does not disclose stacking platforms associated with external elements of a plastic container.

U.S. Pat. No. 4,917,257 (Edelhoff) discloses a small plastic refuse container including an integrally molded-in pocket that supports the container during mechanical lifting.

Other embodiments of plastic containers are known in the art. The art, however, is devoid of large plastic refuse containers having attachable side fork pockets.

SUMMARY OF THE INVENTION

It is an object of this invention to provide a plastic refuse container having side fork pockets that are capable of being lifted with a front load refuse truck. The side fork pockets are secured to the container in such a manner that the plastic container rim supports the weight of the container when the container is lifted with a front load refuse truck.

It is yet another object of this invention to provide an injection molded plastic refuse container having a reinforced floor that is tapered towards a drain hole.

It is still another object of this invention to provide an injection molded plastic refuse container having a plugable drain in the side wall.

It is a further object of this invention to provide a plastic refuse container having external side fork pockets that are nestable in one another for storage and shipping purposes.

It is a further object of this invention to provide an injection molded plastic container having a lockable drain plug.

In one embodiment, this invention is a plastic container having a molded plastic body including a floor, a front wall, a rear wall, a first end wall and a second end wall, the combination defining an open top plastic container. The container further includes a rim defining the perimeter of the open top. A side fork pocket is secured to the first end wall and to the second end wall. Each side fork pocket includes a lift tube, and a side-fork pocket housing having a lift tube recess, a plurality of bolt pockets with each bolt pocket including an aperture complimentary to an attaching means, and at least one pillar abutting the rim.

In another embodiment, this invention is a side fork pocket for use on a plastic container. The side fork pocket comprises a side fork pocket housing, including a lift tube recess, a first lift tube aperture a second lift tube aperture and a plurality of bolt pockets. Each bolt pocket includes a bolt pocket aperture. The side fork pocket further includes a metal lift tube complementary to the lift tube recess and having a first open end and a second open end. The first and second open ends are complimentary to the first and second opposing lift tube apertures respectively. The metal lift tube further includes a short face that abuts the lift tube recess of the side fork pocket housing and a long face. The metal lift tube is secured to the side fork pocket housing with at least one lift tube retainer. The lift tube retainer includes an angled shim for fixedly securing the metal lift tube into the lift tube recess of the side fork pocket.

In another embodiment, this invention is a side fork pocket for use on a plastic container. The side fork pocket comprises a lift tube and side fork pocket housing including a first lift tube aperture opposing a second lift tube aperture a plurality of upper bolt pockets and a plurality of lower bolt pockets, each bolt pocket including a bolt pocket aperture. One or more lower bolt pockets include a stacking perch that prevents stacked or nested container from becoming wedged in one another.

In still another embodiment, this invention is a plastic container having an injection molded plastic body including a front wall, a rear wall, a first end wall, a second end wall and a floor having a top dimension and a bottom dimension. The bottom dimension of the floor includes a perimeter rib, a plurality of first ribs integral to the perimeter rib and linking the front wall and the rear wall, and a plurality of second ribs integral to the perimeter rib and linking the first end wall and the second end wall.

In still another embodiment, this invention is an injection molded plastic container having a molded plastic body including a front wall, a rear wall, a first end wall, a second end wall, a floor, and a drain hole having a locking site complimentary to a wall and adjacent to the floor. The container further includes a locking drain plug complimentary to the locking site.

These and other objects and features of the invention will be apparent from the following description and claims.

DESCRIPTION OF THE DRAWINGS

There is shown in the drawings presently preferred embodiments of a plastic refuse container of this invention wherein:

FIGS. 1-3 are assembly, back and side views respectively of a side fork pocket housing and side fork pockets of this invention.

FIG. 11 is an isometric view of a lockable drain plug of this invention and FIGS. 12-14 detail various aspects of a lockable drain plug of this invention.

DETAILED DESCRIPTION OF THE PREFERRED EMBODIMENTS

The plastic refuse container of this invention is designed to be manufactured by injection molding. However, the container may be manufactured by blow molding or by spin molding. A plastic refuse container of this invention will typically have a volume of two cubic yards or more and is manufactured of a plastic such as high density polyethylene or any other plastic material suitable for injection molding.

The plastic refuse container of this invention includes a number of novel features. A first novel feature are individual side fork pockets that are secured to the end walls of the container. The side fork pockets include bolt pockets having one or more pillars which direct the weight of the container to the container rim thereby allowing the rim to support the weight of the container when it is lifted. The lower bolt pockets may also include stacking perches. The stacking perches, thereby allowing a number of plastic containers to be stacked and nested in other another for storage and shipping purposes. The side fork pockets of the container of this invention may also include lift tube retainers. Each lift tube retainer includes an angled shim which contacts a lift tube and secures the lift tube into the lift tube recess of a side fork pocket housing. When the side fork pockets are attached to the side walls of a plastic refuse container the lift tube retainer makes the lift tube essentially immobile during container lifting procedures. Finally, the plastic refuse container of this invention includes a novel drain and drain plug and a novel floor support structure.

Figure 4:
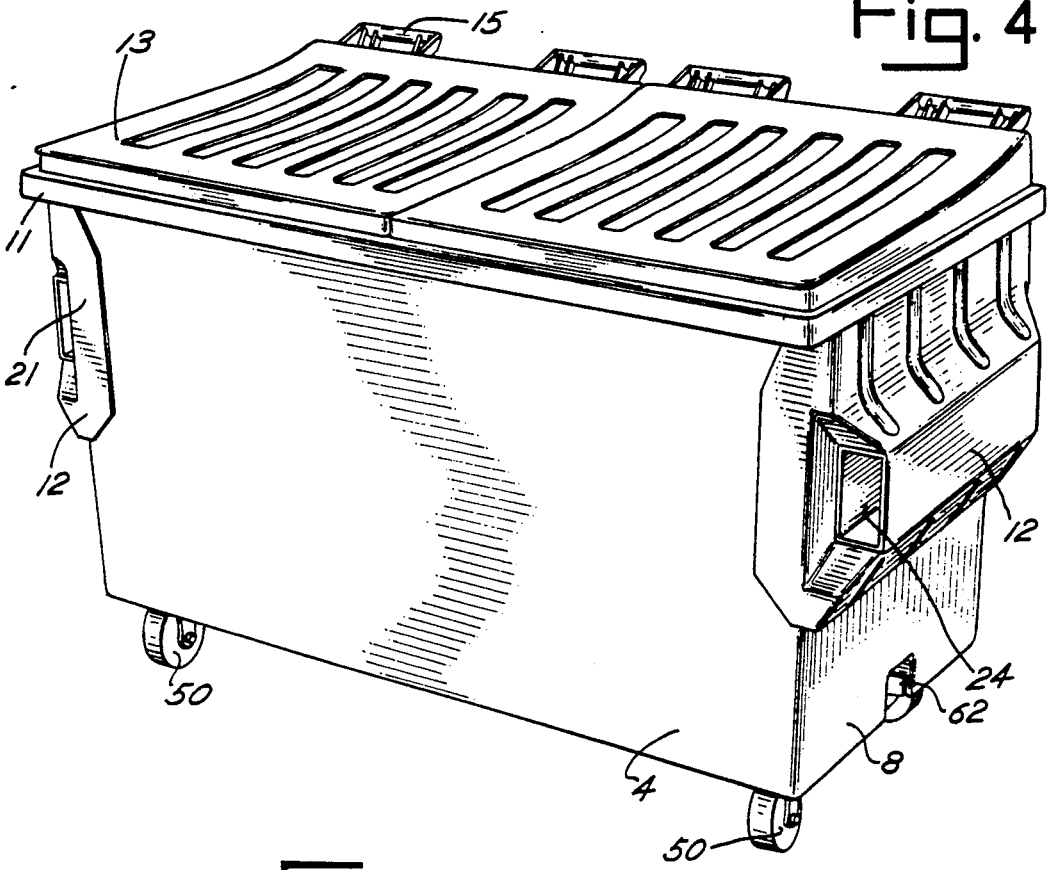
FIG. 4 is an isometric view of an assembled plastic refuse container of this invention.
Figure 5:
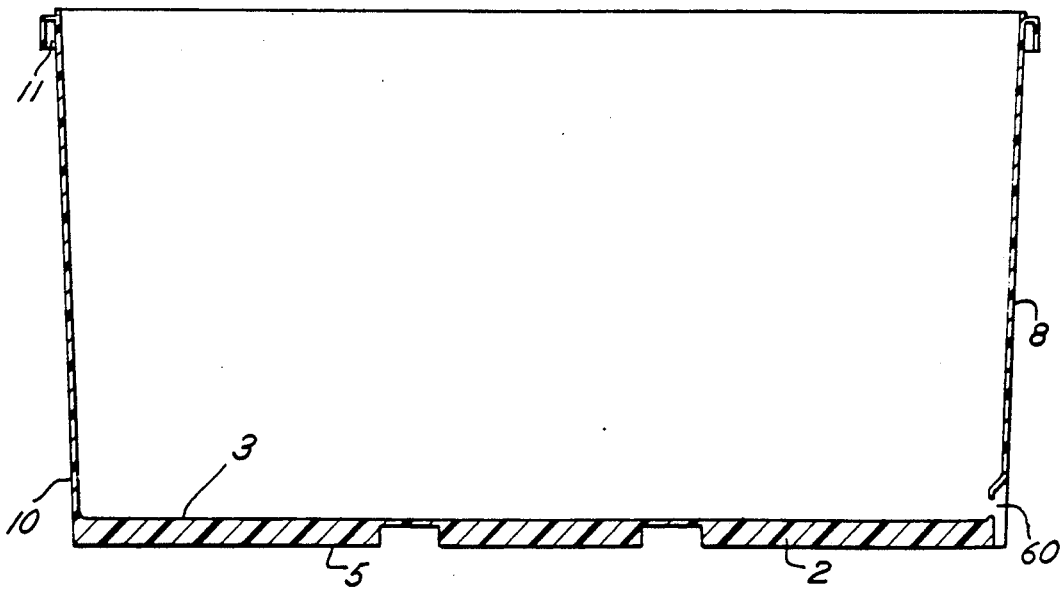
FIG. 5 is a cut-away front view of an open top plastic container of this invention.

Referring now to FIGS. 4 and 5, there is illustrated a plastic refuse container of this invention. The plastic refuse container includes a floor 2 having a top dimension 3 and a bottom dimension 5, a front wall 4, a rear wall 6 (not shown), a first end wall 8 and a second end wall 10. The combination of floor 2 and the walls defines an open top plastic container. A rim 11 defines the top perimeter of the open top plastic container of this invention. Rim 11 may include rim ribs that lend support to rim 11 and to the upper portions of the container walls. Additionally, the plastic container of this invention may include one or more covers 13 which are attached to rear wall 6 with hinges 15.

The plastic refuse container may include a plurality of castors 50. Alternatively, the plastic refuse container may rest on skids. If castors 50 are used, then they are typically complementary to the four corners or to the extreme dimensions of the plastic container in order to uniformly support the container weight.

Referring to FIGS. 1-3 and 7-8, there are illustrated various views and elements of a side fork pocket 12 and side fork pocket housing 14 of this invention. A plastic refuse container of this invention will include two side fork pockets 12. A first side fork pocket 12 is secured to the external dimension of first end wall 8 while a second side fork pocket 12 is secured to the external dimension of second end wall 10. Side fork pockets 12 are secured to the first end wall 8 and the second end wall 10 such that pillars 22 or pillar rail 39 abuts the bottom dimension of rim 11 of the plastic refuse container.

Side fork pockets 12 may be secured to the container by any means known in the art including, for example, with adhesives or with mechanical attaching means. It is preferred that a mechanical attaching means such as a bolt and nut combination be used. However, any securing means that is able to withstand the stresses put on the container and side fork pockets during container lifting may be used.

Side fork pockets 12 include a plurality of bolt pockets 16. Each bolt pocket 16 includes a bolt pocket aperture 20 which is complimentary to an aperture in first end wall 8 or second end wall 10. Preferably, a bolt 29 or some other securing means passes through each bolt pocket aperture 20 and through the complementary aperture in first end wall 8 or second end wall 10 where it is united with a nut thereby securing side fork pocket 12 to the end wall of a plastic refuse container.

Each side fork pocket 12 includes a pair of ears 21 that abut front wall 4 and rear wall 6. Ears 21 protect front wall 4 and rear wall 6 from being damaged by the forks of a front-load refuse truck as the fork s are being inserted into the lift tube.

Each side fork pocket 12 also includes a lift tube 24 that is secured in a lift tube recess 19 in side fork pocket housing 14. When side fork pocket 12 is secured to a plastic refuse container, lift tube 24 is secured in depression 19 of side pocket housing 14 with tube retainer 31. The purpose of lift tube 24 is to retain the forks of a fork lift or garbage truck during container lifting. Therefore, lift tubes 24 must be made of a strong material such as a metal in order to preserve the integrity of lift tube 24 during the container lifting process. Lift tube 24 includes a first opening 25 and a second opening 26, both openings are complementary to a the forks of a front-load refuse truck. Side fork pocket housing 14 includes a first lift tube aperture 27 and a second lift tube aperture 28 complimentary to first opening 25 and second opening 26. First lift tube aperture 27 and second lift tube aperture 28 are preferably outwardly tapered in order to direct the travel of the lifting forks towards first opening 25 or second opening 26 in lift tube 24.

FIGS. 2-3 and 7-8 are front and side views of a side fork pocket housing 14 of this invention. Side fork pocket housing 14 includes pillars 22 which, when installed on end wall of a plastic refuse container, abut rim 11. Pillars 22 transfer the weight of the plastic refuse container from side fork pockets 12 to rim. Alternatively, rim 11 may include ribs in which case pillars 22 or pillars rail 39 will abut the rim ribs.

Side fork pocket housing 14 includes a plurality of bolt pockets 16. Typically, side fork pocket housing 14 will include two or more and preferably eight bolt pockets 16. Additionally, it is preferred that bolt pocket 16 are paired in a directly opposing fashion on each side fork pocket housing 14. It is most preferred that there are four upper bolt pockets 16A opposed by four lower bolt pockets 16B.

Each bolt pocket includes one or more pillars 22. Preferably each bolt pocket 16 includes two parallel pillars 22. Pillars 22 are located on inner face 35 of side fork pocket housing 14. Pillars 22 are oriented perpendicular to rim 11 of the refuse container. Additionally, pillars 22 are preferably united at the top of each bolt pocket 16 by pillar rail 39. Pillars 22 or optional pillar rail 39 of side fork pocket housing 14 abuts the bottom dimension of rim 11 of the plastic refuse container and, evenly distribute the weight of the container along the entire portion of rim 11 that is integral to first end wall 8 and to second end wall 10. When the plastic refuse container is lifted with lifting forks, the weight of the container is not supported by side fork pockets 12 via attaching bolts 29. Instead, pillars 22 transfer the weight of the container evenly along rim 11 thereby dispersed the container weight along rim 11.

If the side fork pocket securing means, such as a bolt, supported the weight of the plastic container, then during container lifting, tears or grooves could develop in the first end wall 8 and second end wall 10 in the neighborhood of the apertures that pass through the end walls. Such tears would eventually result in the failure of the plastic refuse container.

Figure 7:
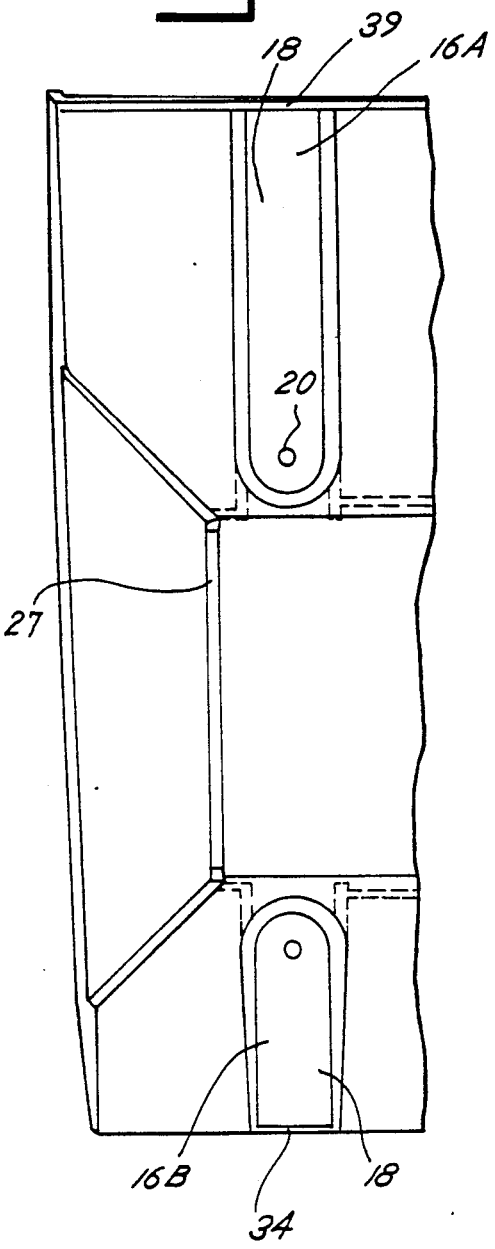
FIGS. 7 and 8 are front and side views respectively of a side fork pocket of this invention including a stacking perch.
Figure 8:
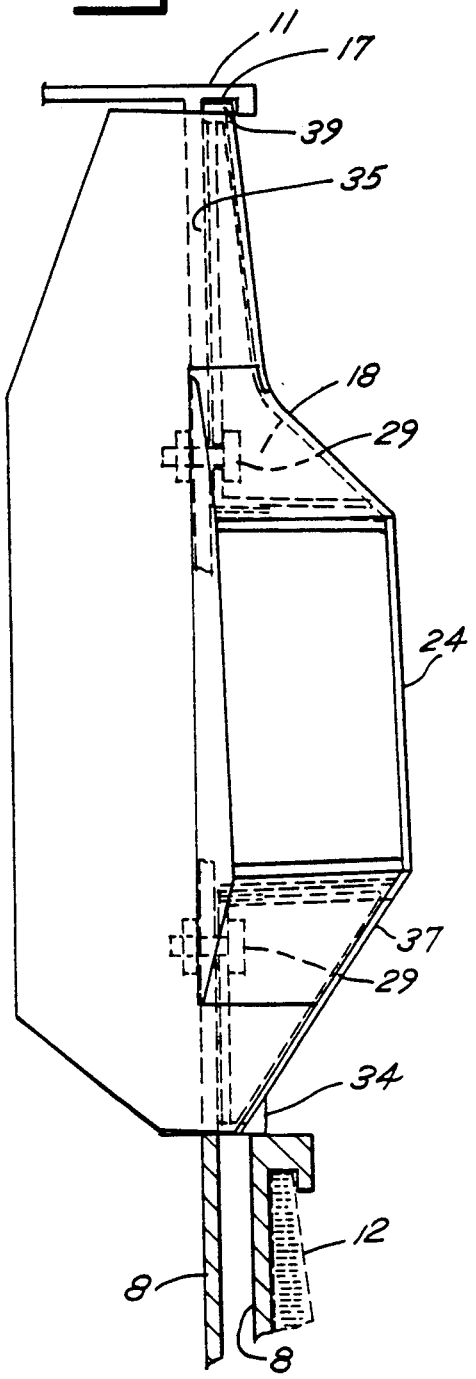

Referring to FIGS. 7 and 8, the plastic refuse containers of this invention are designed to be stackable or nestable for storage and shipping purposes. To achieve this end, side fork pocket housing 14 of this invention include lower bolt pockets 16B having stacking perches 34. The purpose of stacking perches 34 is to prevent two or more containers from becoming wedged in one another when they are nested or stacked, as shown in FIG. 8.

As mentioned above, side fork pocket housing 14 includes a plurality of opposing bolt pockets 16. Each upper bolt pocket 16A preferably has a corresponding opposing lower bolt pocket 16B. One or more and preferably each lower bolt pocket 16B includes a stacking perch 34. Stacking perch 34 is located on the dimension of bolt pocket 16B that is furthest from bolt pocket aperture 20. Stacking perches 34 must be wide enough to prevent the bottom dimension of side fork pocket housing 14 from becoming wedged in the container in which it is nested. Nesting the containers allows for efficient shipping and storage of two or more containers. Stacking perches 34 also insure that the stacked or nested containers can be easily separated for use.

Figure 6:
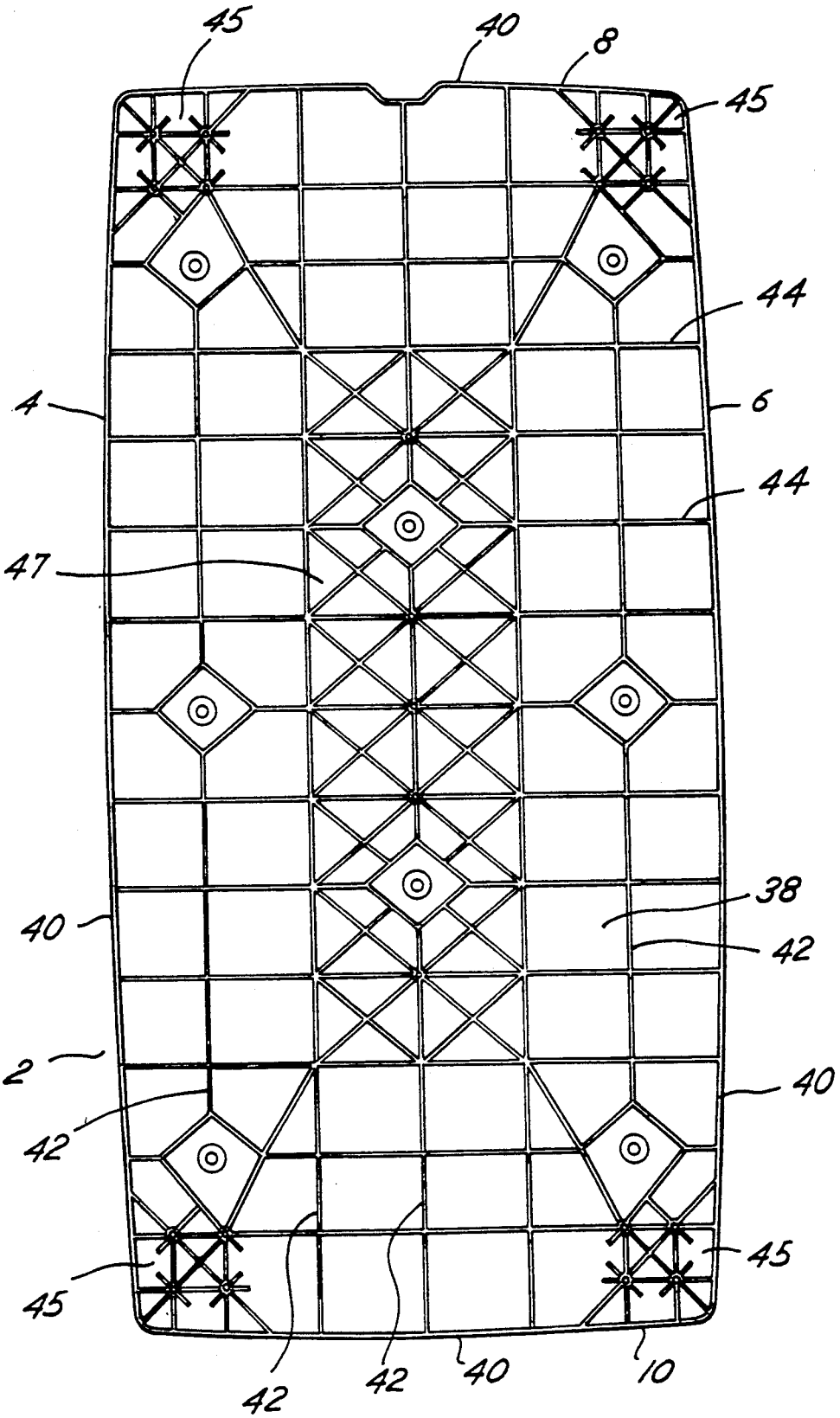
FIG. 6 is a view of the ribbing structure located on the bottom dimension of the floor of a plastic container of this invention.

Injection molded containers arc generally small and include floor ribbing associated only with castor attachment pads and sometimes include perimeter ribbing around bottom dimension 38 of the container. Referring to FIG. 6, the plastic refuse container of this invention includes a first set of ribs 42 and a second set of ribs 44 integral to a perimeter rib 40 and to the bottom dimension 38 of floor 2. First ribs 42 are integral to the perimeter rib and run continuously from first end wall 8 to second end wall 10. Second rib 44 are integral to perimeter rib 40 and run continuously from front wall 4 to rear wall 6. Perimeter rib 40 is integral to front wall 4, rear wall 6 and First and second end walls 8 and 10.

It is preferred that there are a plurality of first ribs 42 and a plurality of second ribs 44. It is also preferred that the ribs are essentially evenly spaced across the bottom dimension 38 of floor 2. The ribs function to support the floor and prevent the floor from warping under load by transferring some of the floor load to the walls of the container thereby giving additional integrity to the side walls of the container. Additionally, ribs 42 and 44 prevent the propagation of any hole or cuts in the bottom of the container by strengthening the entire floor 2. Without the ribs, the weight added to the container would warp the floor causing holes and cuts to widen and lengthen resulting in the failure of floor 2. To further improve the structural integrity of floor 2, "X"-shaped corner ribs 45 and "X"-shaped center ribs 47 are included. These "X"-shaped ribs also prevent sagging of floor 2.

It is preferred that the ribs are approximately two inches tall at second end wall 10 and one and one half inches wide at first end wall 8 providing for floor 2 that slopes from second end wall 10 towards first end wall 8.

It is important that the lift tube 24 associated with side fork pocket housing 14 be essentially immobile prior to attachment to first side wall. Additionally, the lift tube 24 should not extrude through apertures in the side fork pocket housing 14 when the lift tube is improperly engaged with lifting forks, an event that frequently occurs. Tube retainer 31 is used to secure lift tube 24 in lift tube recess 19 to prevent extrusion of lift tube 24 by a misaligned lifting fork. Tube retainer 31 incorporates an angled shim 33 that fills any gap between lift tube recess 19 and lift tube 24 thereby rendering lift tube 24 immobile.

Figure 9:
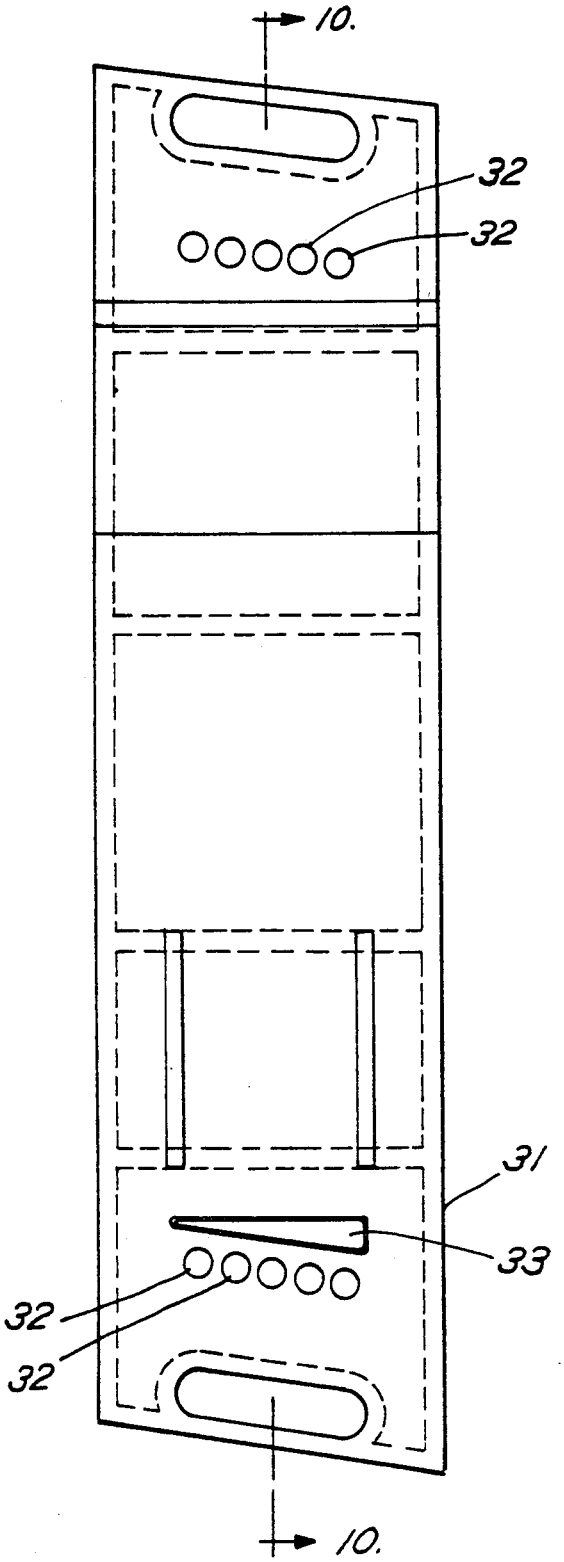
FIGS. 9 and 10 are front and side views respectively of a lift tube retainer of this invention.
Figure 10:
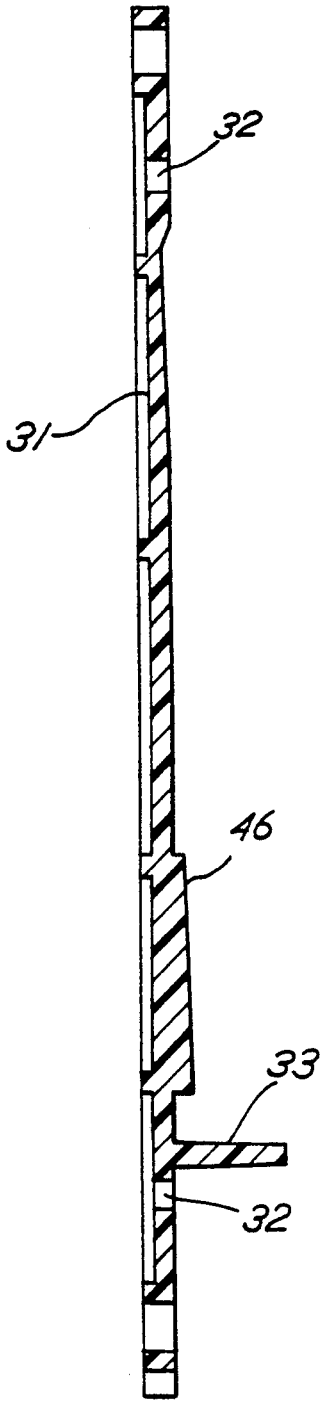
Figure 15:
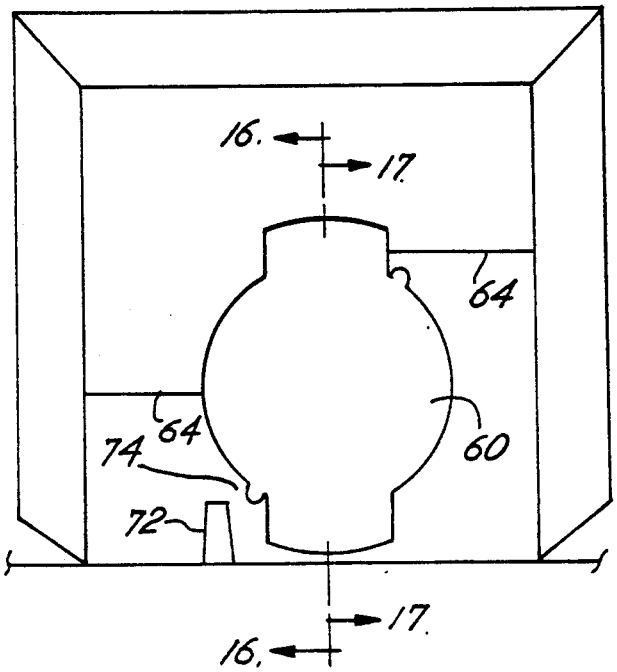
FIGS. 15-17 are top and front views respectively of a drain hole of this invention including a locking site.
Figure 16:
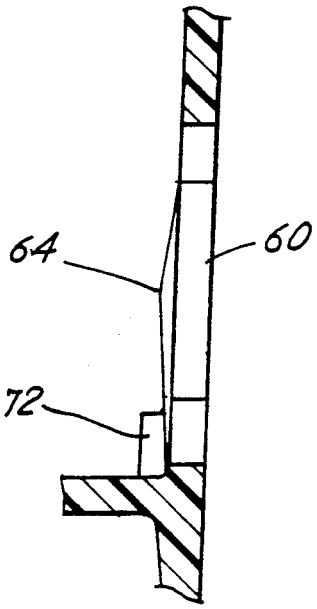
Figure 17:
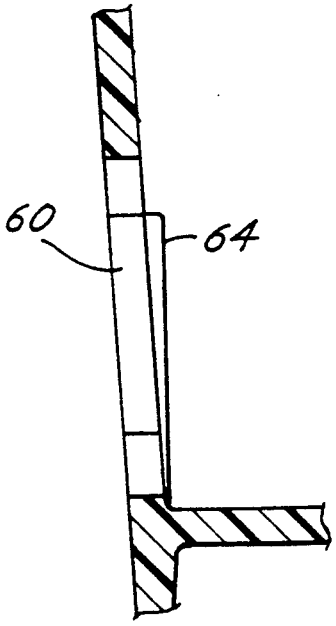

Tube retainer 31 is made of a strong rigid material. Tube retainer 31 may be such as metal or hard plastic. It is preferred that tube retainer 31 is made of high density polyethylene. Referring to FIGS. 9 and 10, tube retainer 31 includes a plurality of upper and lower tube retainer apertures 32. Tube retainer apertures 32 are complimentary to a single securing point on the inner dimension of side fork pocket housing 14. Tube retainer 31 is secured to side fork pocket housing 14 with a securing means such as a screw that passes the screw through the tube retainer aperture 32 which is most complimentary with the aperture on the inner dimension of fork pocket housing 14.

Tube retainer 31 includes an angled shim 33. Angled shim 33 is oriented perpendicular to tube retainer body 46. The purpose of angled shim 33 is to occupy any gap between lift tube 24 and lift tube recess 19 in side fork pocket housing 14.

Referring to FIG. 1, lift tube 24 is installed inside fork pocket housing 14 by placing short face 29 of lift tube 24 into lift tube recess 19 of side fork pocket housing 14. Next, tube retainer 31 is placed into contact with one end of long face 30 of tube retainer 24 so that angled shim 33 contacts lift tube 24. Tube retainer 31 is then moved towards the right of lift tube 24 until angled shim 33 forces lift tube 24 to securely abut recess 19. At this point, a screw or some other attaching means is passed through the appropriate tube retainer aperture and the tube retainer is secured to side fork pocket housing 14 thereby locking lift tube 24 into lift tube recess 19 of side fork pocket housing 14.

Preferably, each side fork pocket 12 includes two tube retainers 31 located in the vicinity of the end of long face 30 of lift tube 24. The second tube retainer is installed in the same manner as described above.

The plastic refuse container of this invention also includes a drain plug 62 complementary to drain hole 60 associated with a side wall of the plastic refuse container. Drain hole 60 is typically associated with a depression in first end wall 8 or second end wall 10. Associating drain hole 60 with second end wall 10 is preferred in order to prevent a refuse truck driver from being splashed with liquids flowing out of drain hole 60 during container lifting procedures. It is also preferred that floor 2 is sloped towards drain hole 60 to facilitate draining of the plastic refuse container by gravity.

Prior art designs typically place drain plugs in the floors of containers because such a location is easy to design and eliminates the need for a special mechanical release mean to be included on the mold. However, a more preferred location of a drain hole is in the side wall of the container as close to the floor as possible. A side wall location is very difficult to design and typically requires the need to include a mechanical release mean in the mold. Moreover, injection molded containers cannot have any ridges or shoulders (otherwise referred to as "undercuts"), or other elements that might impede or prevent the container from being removed from mold following the injection molding process. As part of this invention, a unique design was developed to allow for a drain hole to be positioned in the side wall without the need for inclusion of undercuts. Referring now to FIGS. 12–17, drain hole 60 includes a locking drain plug 62. Therefore, locking sites 64 and drain plug stop 72 had to be constructed so that their dimensions of allow for easy removal of the plastic refuse container from the injection molding mold. This is accomplished by orienting locking sites 64 and drain plug stop 72 perpendicular to floor 2 of the plastic refuse container so that the container is removed from the injection molding mold in the same direction that locking site 64 is oriented. Without such an orientation, a mechanical release mean integral to the injection mold would have been necessary to release the molded plastic container.

Locking drain plug 62 includes a lock having at least one angled face 66 that engages at least one locking site 6,1. Locking drain plug 62 preferably includes two angled face locks 66 with each angled face lock 66 complimentary to a discrete locking site 64. Locking drain plug 62 also includes a washer 68 for sealing drain hole 60 when locking drain plug 62 is in a locked position. Finally, locking drain plug 62 includes at least one detent 70 and preferably two detents 70 oriented on drain plug column 76 as shown in FIG. 14. Detents 70 are complementary to detent stops 74 in drain hole 60. When drain plug 62 is secured in drain hole 60, detents 70 prevent drain plug 62 from vibrating open.

Drain hole 60 is an aperture that is complimentary to and slightly larger than the shape of angled face lock 66. Angled face lock 66 is located at the end of drain plug column 76 that is associated with the handle of locking drain plug 62. Angled face locks 66 are engaged by aligning drain plug 62 with drain hole 60 and rotating drain plug 62 until both angled face locks 66 engage locking sites 64. The angled nature of angled face lock 66 acts as a wedge and draws locking drain plug 62 towards the side wall of the plastic refuse container thereby tightly sealing the drain hole 60. The locking drain plug 62 is removed from locking site 64 by reversing the steps described above. Drain plug 62 is prevented from freely rotating from its desired position by the compression of washer 68 around drain hole 60 and by drain plug stop 72.

The description above has been offered for illustrative purposes only, and is not intended to limit the scope of this invention of this application which is defined by the following claims.

What is claimed is:

1. A plastic container having a molded plastic body including a floor, a front wall, a rear wall, a first end wall, and a second end wall, the combination thereof defining an open topped plastic container, the container further including a rim defining the perimeter of the open top, a side fork pocket secured to the first end wall and a side fork pocket secured to the second end wall, each side fork pocket including a lift tube, and a side fork pocket housing having a plurality of bolt pockets, with one or more bolt pocket including at least one pillar abutting the rim.

2. The plastic container of claim I wherein each side fork pocket includes four bolt pockets.

3. The plastic container of claim I wherein each side fork pocket includes four pairs of opposing bolt pockets.

4. The plastic container of claim I wherein each bolt pocket includes two parallel pillars integral to a pillar rail that abuts the rim.

5. A plastic container having a molded plastic body including a floor, a front wall, a rear wall, a first end wall, a second end wall, the combination thereof defining an open topped plastic container, the container further including a rim defining the perimeter of the open top, a side fork pocket secured to the first end wall, and a side fork pocket secured to the second end wall, each side fork pocket including a lift tube and a side fork pocket housing having four upper bolt pockets and four lower bolt pockets, with each upper bolt pocket including two parallel pillars integral to a pillar rail that abuts the rim.

6. The plastic container of claim 5 wherein each upper bolt pocket opposes a complementary lower bolt pocket.

7. The plastic container of claim 5 wherein the side fork pockets are secured to the first and second end walls with bolts.

8. A side fork pocket for use on a plastic container comprising:

a housing including a lift tube recess, a first lift tube aperture, a second lift tube aperture, and a plurality of bolt pockets, each bolt pocket including a bolt pocket aperture;

a lift tube located in the lift tube recess having a first open end complementary to the first lift tube aperture, a second open end complementary to the second lift tube aperture, a short face that abuts an inner dimension of the side fork pocket housing and a long face; and one or more tube retainers complementary to the long face of the lift tube and secured to side fork pocket housing each tube retainer further including an angled shim for securing the lift tube in the lift tube recess.

9. The side fork pocket of claim 8 having two tube retainers.

10. A side fork pocket for use on a plastic container comprising:

a housing including a lift tube recess, a first lift tube aperture, a second lift tube aperture, a plurality of upper bolt pockets, and a plurality of lower bolt pockets each bolt pocket including a bolt pocket recess including a bolt pocket aperture, a lift tube secured in the lift tube recess; and a stacking perch associated with at least one lower bolt pocket.

11. The side fork pocket of claim 10 wherein each lower bolt pocket includes a stacking perch.

* * * * *